US010566170B2

(12) United States Patent
Jeong et al.

(10) Patent No.: US 10,566,170 B2
(45) Date of Patent: Feb. 18, 2020

(54) X-RAY IMAGING DEVICE AND DRIVING METHOD THEREOF

(71) Applicant: Electronics and Telecommunications Research Institute, Daejeon (KR)

(72) Inventors: Jin-Woo Jeong, Daejeon (KR); Yoon-Ho Song, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 16/123,374

(22) Filed: Sep. 6, 2018

(65) Prior Publication Data

US 2019/0080876 A1 Mar. 14, 2019

(30) Foreign Application Priority Data

Sep. 8, 2017 (KR) ..... 10-2017-0115456
Aug. 6, 2018 (KR) ..... 10-2018-0091424

(51) Int. Cl.

| | |
|---|---|
| ***H05G 1/52*** | (2006.01) |
| ***H01J 35/14*** | (2006.01) |
| ***H01J 35/08*** | (2006.01) |
| ***H05G 1/26*** | (2006.01) |
| ***H05G 1/32*** | (2006.01) |
| ***H01J 35/06*** | (2006.01) |

(52) U.S. Cl.

CPC ..... *H01J 35/14* (2013.01); *H01J 35/065* (2013.01); *H01J 35/08* (2013.01); *H05G 1/265* (2013.01); *H05G 1/32* (2013.01); *H05G 1/52* (2013.01)

(58) Field of Classification Search

CPC ..... H01J 35/14; H01J 36/065; H01J 35/08; H01J 35/147; H05G 1/265; H05G 1/32; H05G 1/52; H05G 1/02

See application file for complete search history.

(56) References Cited

U.S. PATENT DOCUMENTS

| | | | | |
|---|---|---|---|---|
| 6,930,313 | B2 | 8/2005 | Fujieda et al. | |
| 7,284,905 | B2 | 10/2007 | Kuhn | |
| 7,771,117 | B2 * | 8/2010 | Kim | A61B 6/14 378/121 |
| 2005/0057168 | A1 | 3/2005 | Song et al. | |
| 2009/0218930 | A1 | 9/2009 | Lee et al. | |

(Continued)

FOREIGN PATENT DOCUMENTS

| | | | |
|---|---|---|---|
| DE | 102004052911 | A1 | 5/2006 |
| JP | 2012049121 | A | 3/2012 |

(Continued)

*Primary Examiner* — Kiho Kim

(74) *Attorney, Agent, or Firm* — Rabin & Berdo, P.C.

(57) ABSTRACT

Provided is an X-ray imaging device and a driving method thereof, the X-ray imaging device including an electron beam generation unit including a plurality of nano-emitters and a cathode, a first focusing electrode configured to focus an electron beam emitted from the electron beam generation unit, a deflector configured to deflect the electron beam focused by the first focusing electrode, a limited electrode configured to limit traveling of the electron beam deflected by the deflector, and an anode configured to be irradiated with the electron beam to emit an X-ray, wherein the limited electrode includes a limited aperture which the electron beam pass.

18 Claims, 13 Drawing Sheets

(56) References Cited

U.S. PATENT DOCUMENTS

| | | | | |
|---|---|---|---|---|
| 2011/0116603 | A1* | 5/2011 | Kim | H01J 35/065 378/119 |
| 2011/0188635 | A1* | 8/2011 | Cho | H01J 35/06 378/122 |
| 2012/0027177 | A1 | 2/2012 | Ogata et al. | |
| 2013/0022173 | A1* | 1/2013 | Jeong | H01J 35/04 378/122 |
| 2013/0028386 | A1* | 1/2013 | Jeong | H01J 35/20 378/122 |
| 2014/0111081 | A1 | 4/2014 | Jeong et al. | |
| 2014/0185739 | A1* | 7/2014 | Tang | H05G 1/32 378/4 |
| 2014/0241498 | A1 | 8/2014 | Jeong et al. | |
| 2015/0303021 | A1* | 10/2015 | Parker | H01J 35/08 378/10 |
| 2015/0332887 | A1* | 11/2015 | Park | H01J 35/06 378/122 |
| 2017/0148609 | A1 | 5/2017 | Cook et al. | |
| 2017/0162359 | A1* | 6/2017 | Tang | H01J 35/065 |
| 2017/0213688 | A1 | 7/2017 | Ren et al. | |
| 2017/0347438 | A1* | 11/2017 | Kang | H05G 1/34 |

FOREIGN PATENT DOCUMENTS

| | | | |
|---|---|---|---|
| JP | 2017-69468 | A | 4/2017 |
| JP | 2017107849 | A | 6/2017 |
| KR | 10-2008-0114425 | A | 12/2008 |
| KR | 10-0922399 | B1 | 10/2009 |
| KR | 10-2012-0029104 | A | 3/2012 |
| KR | 20140106291 | A | 9/2014 |

* cited by examiner

X-RAY IMAGING DEVICE AND DRIVING METHOD THEREOF

CROSS-REFERENCE TO RELATED APPLICATIONS

This U.S. non-provisional patent application claims priority under 35 U.S.C. § 119 of Korean Patent Application No. 10-2017-0115456, filed on Sep. 8, 2017, the entire contents of which are hereby incorporated by reference.

BACKGROUND

The present disclosure herein relates to an X-ray imaging device and a driving method thereof. More particularly, the present invention relates to an X-ray imaging device capable of acquiring a clear X-ray image and a driving method thereof.

A point electron source means that an electron flow starts from one point thereof. In other words, the point electron source means an electron source from which an electron beam is generated in a very small area like a point. When the electron beam is generated in the very small area like a point, it is easy to focus the generated electronic beam to a very small area again using an electro-optical system, and thus it is advantageous to relatively easily make a fine probe beam. When the diameter of an electron beam is small, the electron beam may be usefully employed in various application fields. For example, the resolution of an electron microscope, such as a scanning electron microscope (SEM) or a transmission electron microscopy (TEM), may be improved, and a focal spot of an X-ray may be reduced to improve the resolution of an X-ray image.

SUMMARY

The present disclosure provides an X-ray imaging device capable of acquiring a clear image, even when a plurality of nano-emitters are provided with.

An embodiment of the inventive concept provides an X-ray imaging device including: an electron beam generation unit including a plurality of nano-emitters and a cathode; a first focusing electrode configured to focus an electron beam emitted from the electron beam generation unit; a deflector configured to deflect the electron beam focused by the first focusing electrode; a limited electrode configured to limit traveling of the electron beam deflected by the deflector; and an anode configured to be irradiated with the electron beam to emit an X-ray, wherein the limited electrode includes a limited aperture which the electron beam pass.

In an embodiment, the X-ray imaging device may further include a gate electrode configured to apply an electric field to the nano-emitters.

In an embodiment, the X-ray imaging device may further include an image acquisition unit configured to acquire an X-ray image using the X-ray emitted from the anode.

In an embodiment, the deflector may include: electrodes separated from each other with an electron beam path therebetween; and a voltage source configured to apply voltages to the electrodes.

In an embodiment, the deflector may include: coils separated from each other with an electron beam path therebetween; and a current source configured to provide a current to the coils.

In an embodiment, the X-ray imaging device may further include a second focusing electrode configured to focus the electron beam passing through the limited aperture.

In an embodiment, the limited electrode may further include a current meter configured to measure a current flowing through the limited electrode.

In an embodiment of the inventive concept, a driving method of an X-ray imaging device include: emitting a plurality of electron beams from an electron beam generation unit; limiting the traveling of the electron beams emitted from the electron beam generation unit by using a limited electrode; and irradiating at least part of the electron beams to an anode, wherein the limited electrode comprises a limited aperture which the electron beam pass.

In an embodiment, the limiting the traveling of the electron beams may include one of the electron beams emitted from the electron beam generation unit passes the limited aperture.

In an embodiment, the electron beam limiting operation may include using a first focusing electrode to focus the electron beams emitted from the electron beam generation unit.

In an embodiment, the limiting the traveling of the electron beams may further include using a deflector to deflect the electron beams focused by the first focusing electrode.

In an embodiment, the limiting the traveling of the electron beams may further include measuring a current flowing through the limited electrode to acquire a current intensity map of the limited electrode.

In an embodiment, the using a first focusing electrode to focus the electron beams may include: determining whether the current intensity map is clear; and controlling the first focusing electrode to adjust focusing of the electron beams.

In an embodiment, the controlling the first focusing electrode to adjust focusing of the electron beams may include adjusting the focusing of the electron beams to minimize a planar area of the electron beams in a same level as a bottom surface of the limited electrode.

In an embodiment, the using a deflector to deflect the electron beams may include controlling the deflector so as to correspond to a darkest spot on the current intensity map.

In an embodiment, the controlling the deflector may include optimizing a magnitude of a voltage from a voltage source of the deflector.

In an embodiment, the controlling the deflector may include optimizing a magnitude of a current from a current source of the deflector.

In an embodiment, the irradiating at least part of the electron beams may include using a second focusing electrode to focus the one electron beam.

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Advantages and features of the present invention, and methods for achieving the same will be cleared with reference to exemplary embodiments described later in detail together with the accompanying drawings. However, the present invention is not limited to the following exemplary embodiments, but realized in various forms. In other words, the present exemplary embodiments are provided just to complete disclosure the present invention and make a person having an ordinary skill in the art understand the scope of the invention. The present invention should be defined by only the scope of the accompanying claims. Throughout this specification, like numerals refer to like elements.

The terminology used herein is for the purpose of describing particular embodiments only and is not intended to limit the scope of the present disclosure. As used herein, the singular forms "a", "an" and "the" are intended to include the plural forms as well, unless the context clearly indicates otherwise. It will be further understood that the terms "comprises" and/or "comprising" used herein specify the presence of stated components, operations and/or elements but do not preclude the presence or addition of one or more other components, operations and/or elements.

Hereinafter, detailed descriptions about embodiments of the inventive concept will be provided.

Figure 1A:
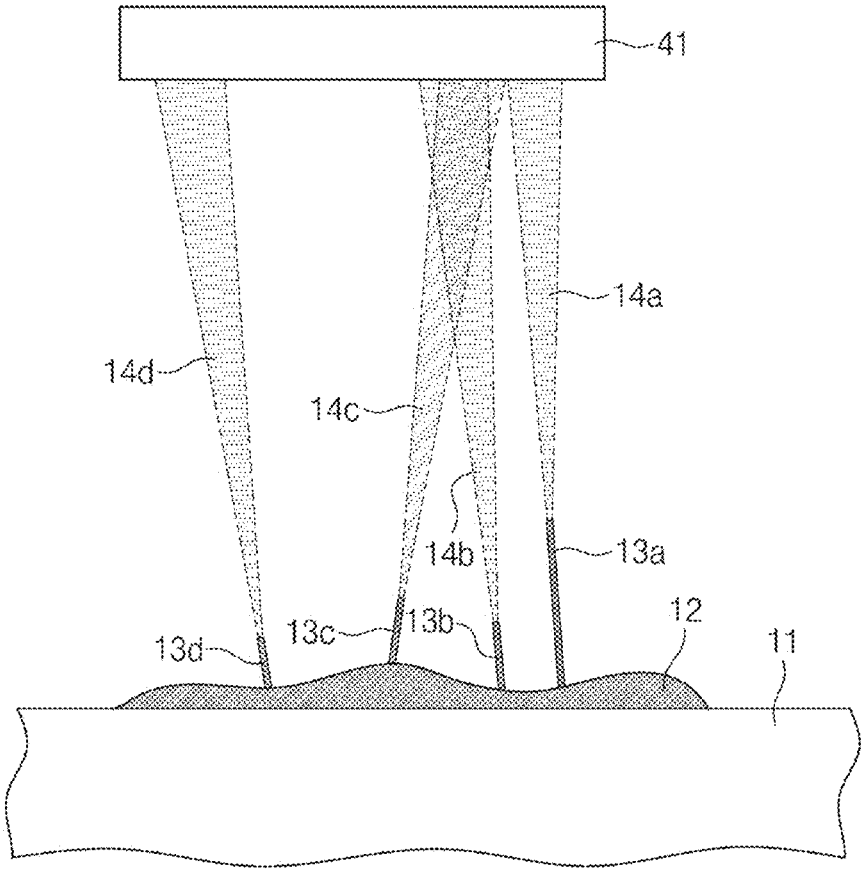
FIGS. 1A and 1B are drawings for explaining characteristics of electron beams generated from nano-emitters.
Figure 1B:
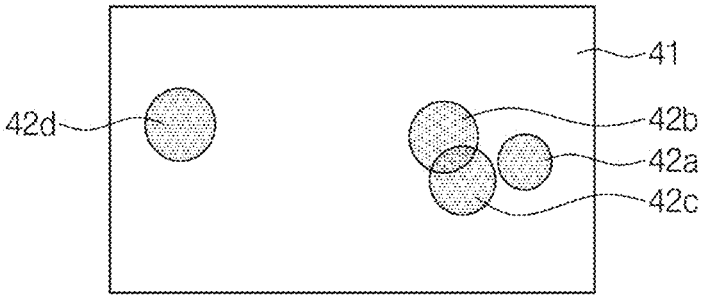

FIGS. 1A and 1B are drawings for explaining characteristics of electron beams generated from nano-emitters.

Referring to FIGS. 1A and 1B, an electron beam device may be provided which includes a cathode 11, first to fourth nano-emitters 13*a* to 13*d* on the cathode 11, and an anode fluorescent film 41. The first to fourth nano-emitters 13*a* to 13*d* may emit first to fourth electron beams 14*a* to 14*d*, respectively. The first to fourth electron beams 14*a* to 14*d* may be irradiated to the anode fluorescent film 41. The first to fourth electron beams 14*a* to 14*d* may be irradiated to the anode fluorescent film 41 to form first to fourth electron beam fluorescent points 42*a* to 42*d* on the anode fluorescent film 41. The first to fourth electron fluorescent points 42*a* to 42*d* may be observed to determine characteristics of the first to fourth electron beams 14*a* to 14*d*. The first to fourth electron fluorescent points 42*a* to 42*d* may be respectively formed so as to correspond to focal spots of the first to fourth electron beams 14*a* to 14*d*. The focal spot may mean a planar area on the surface of the anode fluorescent film 41, which is occupied by each of the first to fourth electron beams 14*a* to 14*d* that are irradiated to the anode fluorescent film 41. In other words, the focal spot may mean the planar area occupied by the electron beam on the surface of an object to which the electron beam is irradiated.

As a voltage difference between the anode fluorescent film 41 and the cathode 11 is larger, the diameter of each of the first to fourth electron beam fluorescent points 42*a* to 42*d* may become small. In other words, as the voltage difference between the anode fluorescent film 41 and the cathode 11 is larger, a focal spot of each of the first to fourth electron beams 14*a* to 14*d*, which are irradiated to the anode fluorescent film 41, may become small. The diameter of each of the first to fourth electron beam fluorescent points 42*a* to 42*d* may become large, as the distance between the anode fluorescent film 41 and the cathode 11 is larger. The distances between the first to fourth electron beam fluorescent points 42*a* to 42*d* may become large, as the distance between the anode fluorescent film 41 and the cathode 11 is larger.

Figure 2A:
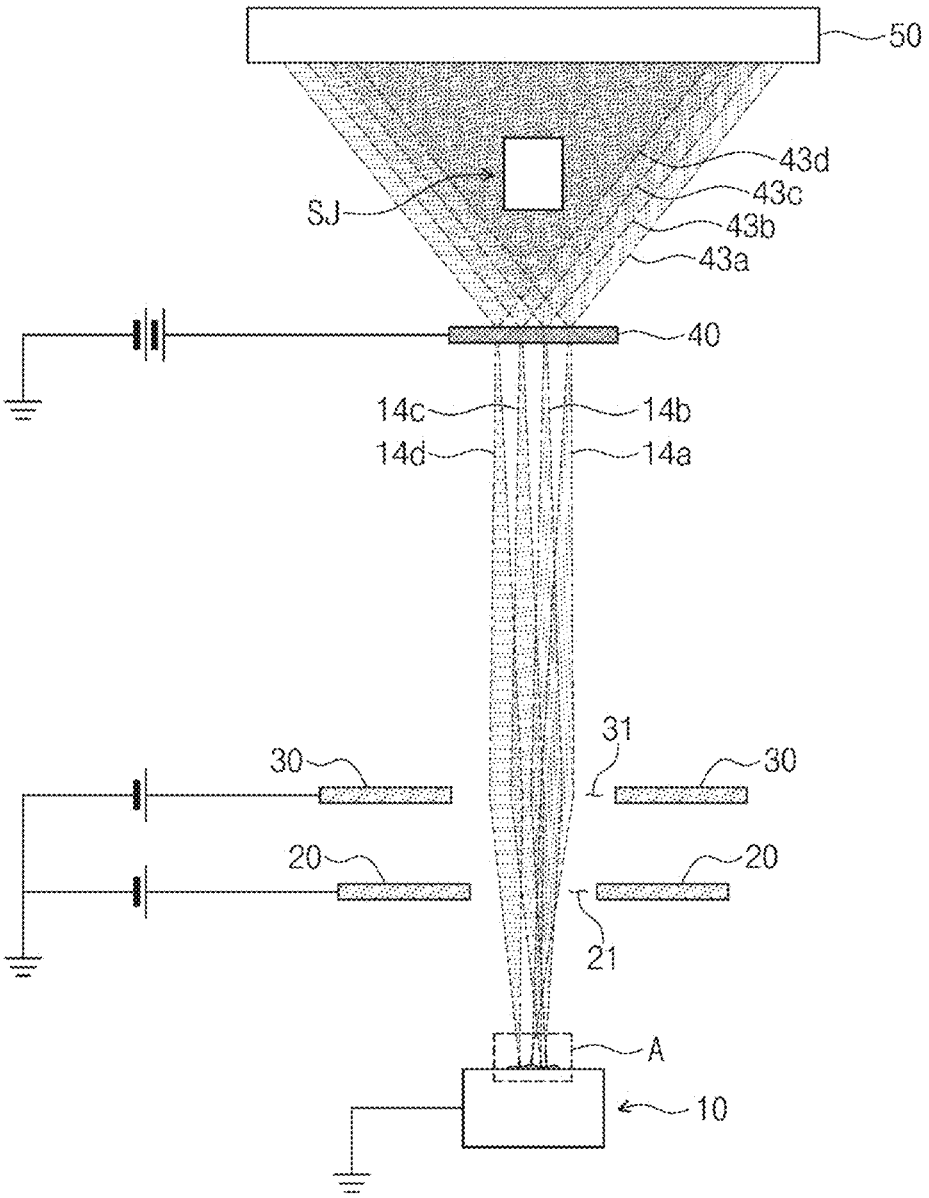
FIG. 2A is a drawing for explaining an X-ray imaging device according to a comparative example of the inventive concept.
Figure 2B:
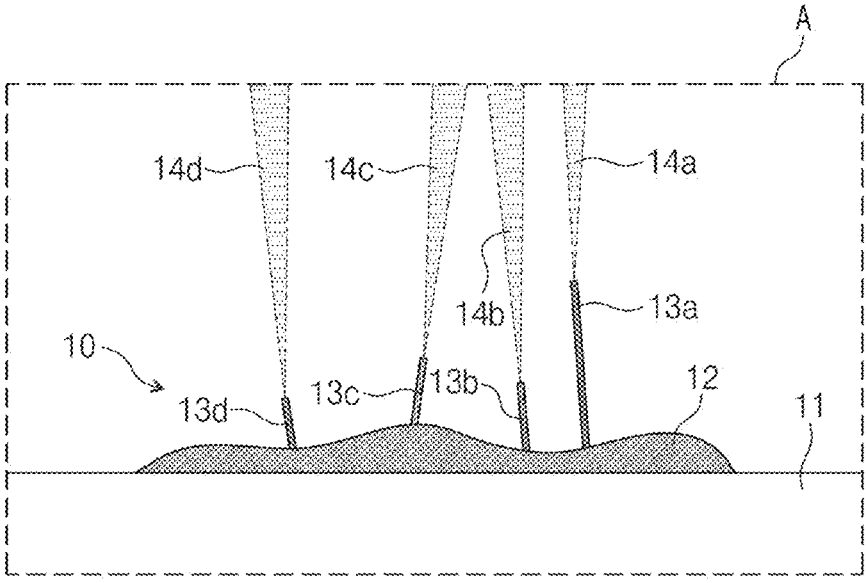
FIG. 2B is an enlarged view of region A of FIG. 2A.

FIG. 2A is a drawing for explaining an X-ray imaging device according to a comparative example of the inventive concept, and FIG. 2B is an enlarged view of region A of FIG. 2A.

Referring to FIGS. 2A and 2B, the X-ray imaging device may include an electron beam generation unit 10, a gate electrode 20, a focusing electrode 30, an anode 40, and an image acquisition unit 50.

The electron beam generation unit 10 may include a cathode 11, an adhesive layer 12 and first to fourth nano-emitters 13*a* to 13*d*.

The first to fourth nano-emitters 13*a* to 13*d* may be provided on the cathode 11. The number of nano-emitters 13*a* to 13*d* is illustrated as four, but the inventive concept is not limited thereto. The cathode 11 may be grounded. The first to fourth nano-emitters 13*a* to 13*d* may be adhered on the cathode 11 by the adhesive layer 12. The first to fourth nano-emitters 13*a* to 13*d* and the adhesive layer 12 may be adhered on the cathode 11 through a paste printing process. The first to fourth nano-emitters 13*a* to 13*d* may be planarly separated from each other. The shortest distance between the first to fourth nano-emitters 13*a* to 13*d* may be about 1 μm to about 200 μm. The first to fourth nano-emitters 13*a* to 13*d* may include a conductive material. For example, each of the first to fourth nano-emitters 13*a* to 13*d* may include carbon nanotube (CNT). The length of each of the first to fourth nano-emitters 13*a* to 13*d* may be different from each other. Angles formed by the first to fourth nano-emitters 13*a* to 13*d* with the top surface of the cathode 11 may be different from each other. In other words, respective degrees of inclination of the first to fourth nano-emitters 13*a* to 13*d* may be different from each other.

The adhesive layer 12 may include an adhesive material. For example, the adhesive layer 12 may include a conductive paste.

The gate electrode 20 may be provided on the electron beam generation unit 10. In other words, the gate electrode 20 may be provided between the electron beam generation unit 10 and the anode 40. A positive voltage may be applied to the gate electrode 20. The gate electrode 20 may include a gate aperture 21. The diameter of the gate aperture 21 may be about 1 μm to about 500 μm. The shortest distance between the gate electrode 20 and the electron beam generation unit 10 may be about 1 μm to about 5000 μm. The shortest distance between the gate electrode 20 and the electron beam generation unit 10 may be about 0.1 times to about 10 times of the diameter of the gate aperture 21.

The focusing electrode 30 may be provided on the gate electrode 20. In other words, the focusing electrode 30 may be provided between the gate electrode 20 and the anode 40.

However, the location of the focusing electrode 30 may not be limited thereto. A positive voltage may be applied to the focusing electrode 30. The focusing electrode 30 may include a focusing aperture 31. Instead of the focusing electrode 30, an optical system (for example, an electrostatic lens or magnetic lens), which may focus an electronic beam, may be provided.

The anode 40 may be provided on the focusing electrode 30. In other words, the anode 40 may be provided between the focusing electrode 30 and the image acquisition unit 50. A positive voltage may be applied to the anode 40. The anode 40 may include an anode target and an anode electrode. The anode target may include a material emitting an X-ray according to irradiation with an electron beam. For example, the anode target may include Tungsten or Molybdenum. The anode electrode may include a material having high conductivity. For example, the anode electrode may include Copper.

The image acquisition unit 50 may be provided on the anode 40. The image acquisition unit 50 may acquire an X-ray image using an X-ray emitted from the anode 40.

A driving method of the X-ray imaging device will be described. A positive voltage may be applied to the gate electrode 20 to generate a voltage difference between the gate electrode 20 and the cathode 11. Due to the voltage difference between the gate electrode 20 and the cathode 11, the first to fourth electron beams 14*a* to 14*d* may be emitted from the first to fourth nano-emitters 13*a* to 13*d*, respectively. The first to fourth electron beams 14*a* to 14*d* may be emitted from end portions of the first to fourth nano-emitter 13*a* to 13*d*, respectively. The length of the first nano-emitter 13*a* may be longest among the first to fourth nano-emitters 13*a* to 13*d*, and the length of the fourth nano-emitter 13*d* may be the shortest. As the lengths of the nano-emitters 13*a* to 13*d* are longer, the voltage difference between the gate electrode 20 and the cathode 11, at which the electron beams 14*a* to 14*d* start to be emitted, may be small. In other words, the voltage difference between the gate electrode 20 and the cathode 11, at which the first electron beam 14*a* starts to be emitted from the first nano-emitter 13*a*, may be smaller than the voltage difference between the gate electrode 20 and the cathode 11, at which the fourth electron beam starts to be emitted from the fourth nano-emitter 13*d*. As the diameters of the nano-emitters 13*a* to 13*d* are smaller, the planar areas of the emitted electron beams 14*a* to 14*d* may be smaller.

A positive voltage may be applied to the anode 40 to generate a voltage difference between the anode 40 and the cathode 11. The first to fourth electron beams 14*a* to 14*d* emitted from the nano-emitters 13*a* to 13*d* may be accelerated by the voltage difference between the anode 40 and the cathode 11 to travel towards the anode 40. The traveling paths of the first to fourth electron beams may be different from each other. In other words, paths along which the first to fourth electron beams 14*a* to 14*d* are emitted from the nano-emitters 13*a* to 13*d* to reach the anode 40 may be different from each other. While traveling towards the anode 40, a part of the first to fourth electron beams 14*a* to 14*d* may overlap each other, and the other may not overlap.

The first to fourth electron beams 14*a* to 14*d* may pass through the gate aperture 21 of the gate electrode 20. The gate aperture 21 may have the sufficient magnitude to pass the first to fourth electron beams 14*a* to 14*d*.

The first to fourth electron beams 14*a* to 14*d* having passed through the gate aperture 21 may pass through the focusing aperture 31. The focusing aperture 31 may have the sufficient magnitude to pass the first to fourth electron beams 14*a* to 14*d*. While passing through the focusing aperture 31, the first to fourth electron beams 14*a* to 14*d* may be focused. The first focusing electrode 30 may be controlled to adjust the focusing such that focal spots of the first to fourth electron beams 14*a* to 14*d* are minimized on the surface of the anode 40.

The first to fourth electron beams 14*a* to 14*d* having passed through the focusing aperture 31 may be irradiated to the anode 40. The locations at which the first to fourth electron beams 14*a* to 14*d* are irradiated may be different from each other on the anode 40. In other words, on the surface of the anode 40, the focal spots of the first to fourth electron beams 14*a* to 14*d* may be separated from each other. The first to fourth electron beams 14*a* to 14*d* may be irradiated to the anode 40, and then first to fourth X-rays 43*a* to 43*d* may be emitted from the anode 40. The locations at which the first to fourth X-rays 43*a* to 43*d* are emitted may be different from each other on the anode 40. In other words, on the surface of the anode 40, emission points of the first to fourth X-rays 43*a* to 43*d* may be separated from each other.

The first to fourth X-rays 43*a* to 43*d* may travel from the anode 40 towards the image acquisition unit 50. Since the emission points of the first to fourth X-rays 43*a* to 43*d* are separated from each other, as the first to fourth X-rays 43*a* to 43*d* travel towards the image acquisition unit 50, traveling paths of the first to fourth X-rays 43*a* to 43*d* may be different from each other. In other words, a part of the first to fourth X-rays 43*a* to 43*d* may overlap each other, and the other part of the first to fourth X-rays 43*a* to 43*d* may not overlap. The first to fourth X-rays 43*a* to 43*d* may be irradiated to a subject SJ disposed between the anode 40 and the image acquisition unit 50.

The first to fourth X-rays 43*a* to 43*d* may be irradiated to the image acquisition unit 50. The image acquisition unit 50 may acquire an X-ray image of the subject SJ. The X-ray images acquired by the first to fourth X-rays 43*a* to 43*d* with the emission points separated from each other may not be clear. In other words, since the X-ray images are acquired by the plurality of X-rays 43*a* to 43*d*, a plurality of images overlapping in a dislocated manner may be included.

Figure 3:
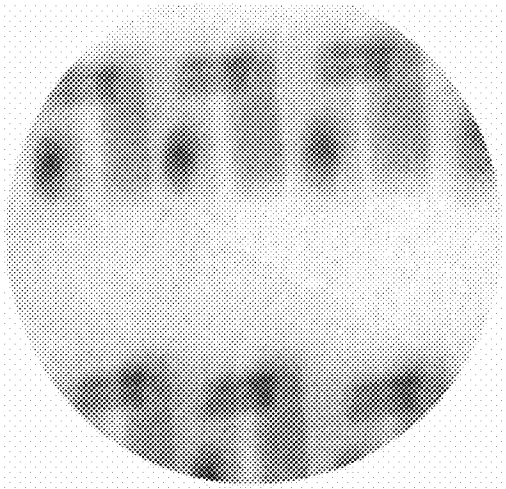
FIG. 3 is an X-ray image acquired by the X-ray imaging device according to FIGS. 2A and 2B.

FIG. 3 is an X-ray image acquired by the X-ray imaging device according to FIGS. 2A and 2B.

Referring to FIG. 3, it may be checked that the subject does not appear clearly in X-ray images acquired by the plurality of X-rays.

Figure 4:
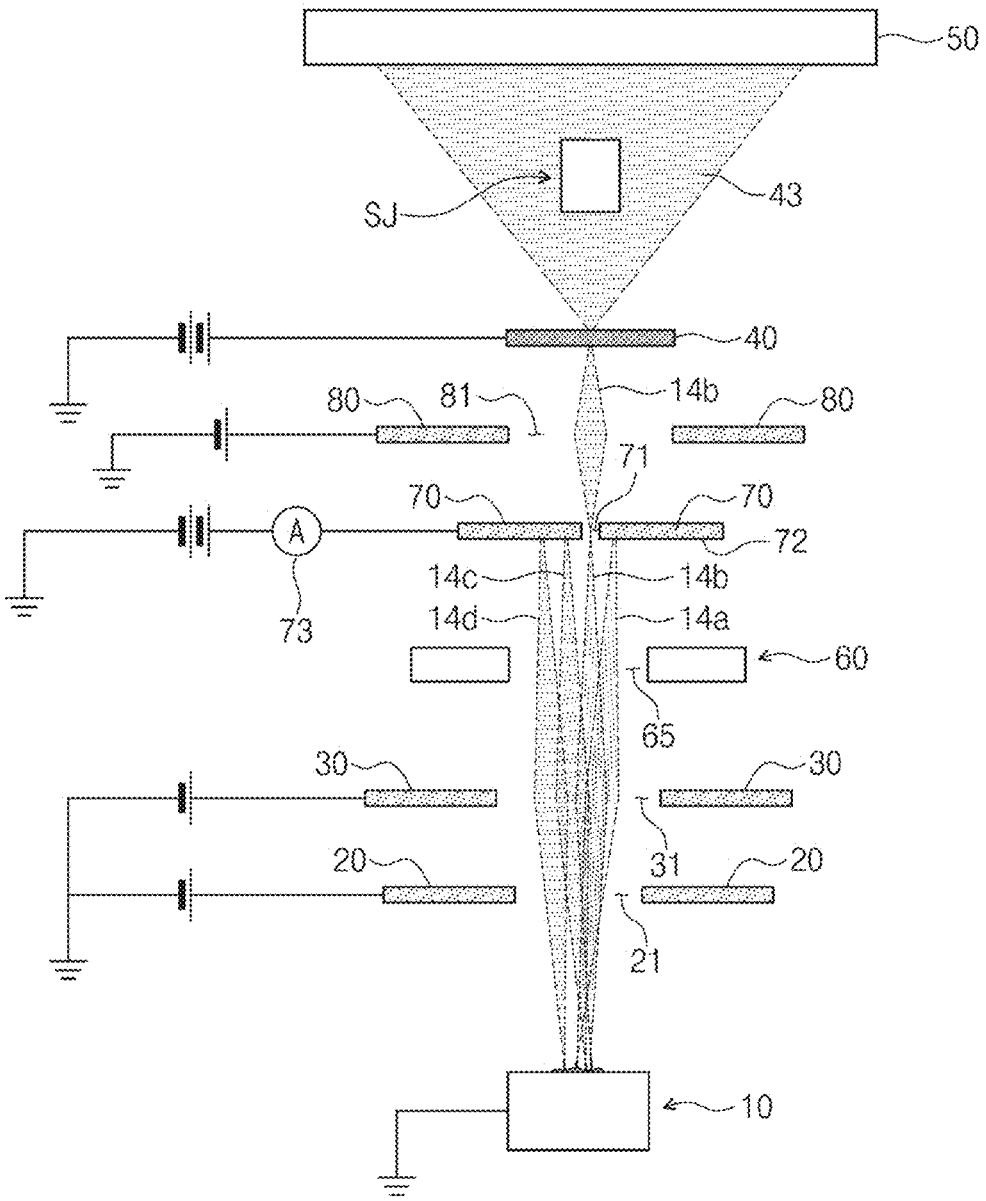
FIG. 4 is a drawing for explaining an X-ray imaging device according to embodiments of the inventive concept.
Figure 5A:
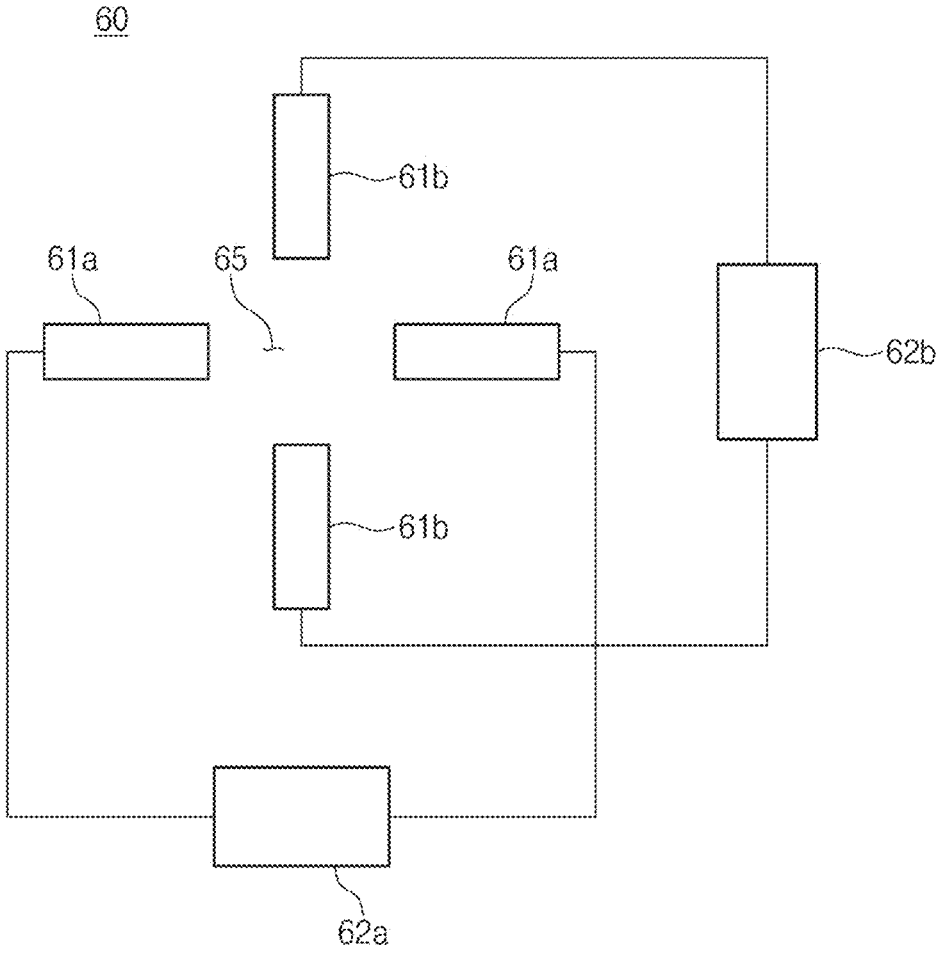
FIGS. 5A and 5B are drawings for explaining embodiments of a deflector.
Figure 5B:
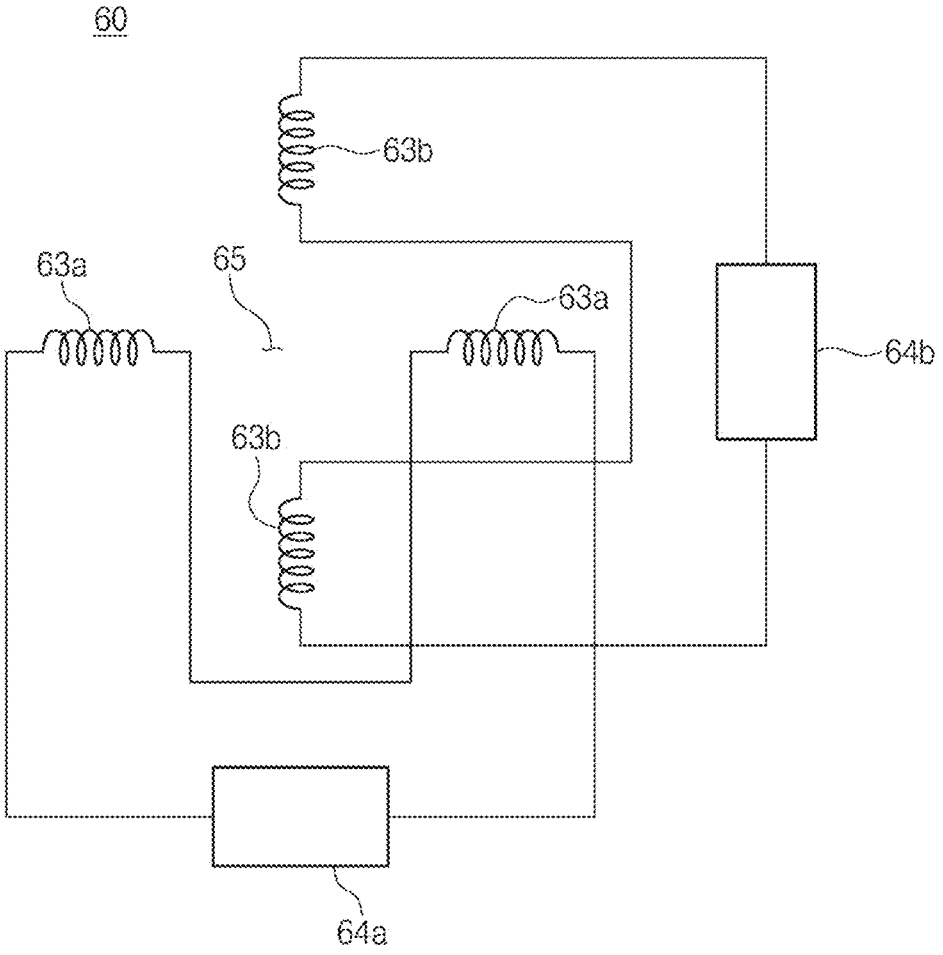

FIG. 4 is a drawing for explaining an X-ray imaging device according to embodiments of the inventive concept, and FIGS. 5A and 5B are drawings for explaining embodiments of a deflector. Like reference numerals may be used for like elements having been explained in relation to FIGS. 2A and 2B, and overlapping explanation will be omitted.

Referring to FIGS. 4, 5A and 5B, the X-ray imaging device may include the electron beam generation unit 10, the gate electrode 20, the focusing electrode 30, the anode 40, the image acquisition unit 50, a deflector 60, a limited electrode 70 and a second focusing electrode 80.

The deflector 60 may be provided on the first focusing electrode 30. In other words, the deflector 60 may be provided between the first focusing electrode 30 and the anode 40. However, the location of the deflector 60 may not be limited thereto. The deflector 60 may be located between the first focusing electrode 30 and the gate electrode 20, or between the gate electrode 20 and the cathode 11 (see FIG. 2B). As an embodiment, the deflector 60 may be an electrostatic deflector (see FIG. 5A). The deflector 60 may include X-axis electrodes 61*a*, Y-axis electrodes 61*b*, an X-axis voltage source 62*a*, and a Y-axis voltage source 62*b*.

An electron beam path 65 may be defined by the X-axis electrodes 61*a* and the Y-axis electrodes 61*b*. The X-axis electrodes 61*a* may be provided on both sides of the electron beam path 65 along the X-axis. The Y-axis electrodes 61*b* may be provided on both sides of the electron beam path 65 along the Y-axis. An X-axis voltage source 62*a* applies a voltage to the X-axis electrodes 61*a* to generate a voltage difference between the X-axis electrodes 61*a*. Accordingly, an electric field may be generated along an X-axis on the electron beam path 65 between the X-axis electrodes 61*a*. A Y-axis voltage source 62*b* applies a voltage to the Y-axis electrodes 61*b* to generate a voltage difference between the Y-axis electrodes 61*b*. Accordingly, an electric field may be generated along a Y-axis on the electron beam path 65 between the Y-axis electrodes 61*b*. The electron beam traveling along the electron beam path 65 may be deflected by the electron fields generated along the X-axis and the Y-axis. The voltage applied by the X-axis voltage source 62*a* may be defined as an X-voltage, and the voltage applied by the Y-axis voltage source 62*b* may be defined as a Y-voltage.

As another embodiment, the deflector 60 may be a magnetic field deflector (see FIG. 5B). The deflector 60 may include X-axis coils 63*a*, Y-axis coils 63*b*, an X-axis current source 64*a*, and a Y-axis current source 64*b*. The electron beam path 65 may be defined by the X-axis coils 63*a* and the Y-axis coils 63*b*. The X-axis coils 63*a* may be provided on both sides of the electron beam path 65 along the X-axis. The Y-axis coils 63*b* may be provided on both sides of the electron beam path 65 along the Y-axis. The X-axis current source 64*a* applies a current to the X-axis coils 63*a* to generate a magnetic field on the X-axis coils 63*a*. The Y-axis current source 64*b* applies a current to the Y-axis coils 63*b* to generate a magnetic field on the Y-axis coils 63*b*. The magnetic fields may pass the electron beam path 65. The electron beam passing along the electron beam path 65 may be deflected by the magnetic fields generated by the X-axis coils 63*a* and the Y-axis coils 63*b*. The current provided by the X-axis current source 64*a* may be defined as a X-current, and the current provided by the Y-axis current source 64*b* may be defined as a Y-current.

The limited electrode 70 may be provided on the deflector 60. In other words, the limited electrode 70 may be provided between the deflector 60 and the anode 40. A positive voltage may be applied to the limited electrode 70. The limited electrode 70 may include a limited aperture 71. The diameter of the limited aperture 71 may be about 1 μm to about 2000 μm. The shortest distance between the electron beam generation unit 10 and the limited electrode 70 may be about 0.1 mm to about 200 mm. The diameter of the limited aperture 71 may be suitably determined according to the shortest distance between the electron beam generation unit 10 and the limited electrode 70. For example, when the shortest distance between the electron beam generation unit 10 and the limited electrode 70 is about 200 mm, the diameter of the limited aperture 71 may be about 2000 μm. For another example, when the shortest distance between the electron beam generation unit 10 and the limited electrode 70 is about 0.1 mm, the diameter of the limited aperture 71 may be about 1 μm. The limited electrode 70 may include the bottom surface 72 opposite to the cathode 11. A current meter 73 may be connected to the limited electrode 70. The limited electrode 70 may include Tungsten or Molybdenum.

The second focusing electrode 80 may be provided on the limited electrode 70. In other words, the second focusing electrode 80 may be provided between the limited electrode 70 and the anode 40. A positive voltage may be applied to the second focusing electrode 80. The second focusing electrode 80 may include a second focusing aperture 81.

The driving method of the X-ray imaging device will be described. The first to fourth nano-emitters 13*a* to 13*d* (see FIG. 2B) on the cathode 11 may emit first to fourth electron beams 14*a* to 14*d*, respectively.

The first to fourth electron beams 14*a* to 14*d* emitted from the nano-emitters 13*a* to 13*d* may be accelerated by the voltage difference between the anode 40 and the cathode 11 to travel towards the anode 40. The traveling paths of the first to fourth electron beams 14*a* to 14*d* may be different from each other.

The first to fourth electron beams 14*a* to 14*d* may pass through the gate aperture 21 of the gate electrode 20.

The first to fourth electron beams 14*a* to 14*d* having passed through the gate aperture 21 may pass through the first focusing aperture 31. While passing through the first focusing aperture 31, the first to fourth electron beams 14*a* to 14*d* may be focused.

The first to fourth electron beams 14*a* to 14*d* having passed through the first focusing aperture 31 may pass along the electron beam path 65 defined by the deflector 60. While passing along the electron beam path 65, the first to fourth electron beams 14*a* to 14*d* may be deflected along the X-axis and the Y-axis (FIGS. 5A and 5B). When the deflector 60 is an electrostatic deflector (FIG. 5A), the first to fourth electron beams 14*a* to 14*d*, which are passing along the electron beam path 65, may be deflected by an electric field generated on the electron beam path 65. When the deflector 60 is a magnetic field deflector (FIG. 5B), the first to fourth electron beams 14*a* to 14*d*, which are passing along the electron beam path 65, may be deflected by a magnetic field passing the electron beam path 65. Deflection of the first to fourth electron beams 14*a* to 14*d* may be adjusted by controlling the deflector 60.

The limited electrode 70 may limit the traveling of the first to fourth electron beams 14*a* to 14*d*. Only one of the first to fourth electron beams 14*a* to 14*d* having passed along the electron beam path 65 may pass through the limited aperture 71 of the limited electrode 70. For example, the second electron beam 14*b* may pass through the limited aperture 71. In the drawing, the second electron beam 14*b* is shown to pass through the limited aperture 71, one of the first, third, and fourth electron beams 14*a*, 14*c*, and 14*d* may pass through the limited aperture 71. The limited aperture 71 may have the suitable size such that only one electron beam is allowed to pass through. According to the deflection of the first to fourth electron beams 14*a* to 14*d* by the deflector 60, an electron beam to pass through the limited aperture 71 may be determined. According to the deflection of the first to fourth electron beams 14*a* to 14*d* by the deflector 60, all of the first to fourth electron beams 14*a* to 14*d* may not pass through the limited aperture 71.

When the second electron beam 14*b* passes through the limited aperture 71, the first, third, and fourth electron means 14*a*, 14*c*, and 14*d* may be irradiated onto the bottom surface 72 of the limited electrode 70. A current may flow through the limited electrode 70 by the first, third, and fourth electron beams 14*a*, 14*c* and 14*d* irradiated onto the bottom surface 72 of the limited electrode 70. The current flowing through the limited electrode 70 may be measured by the current meter 73 of the limited electrode 70.

The second electron beam 14*b* having passed through the limited aperture 71 may pass through a second focusing aperture 81 of the second focusing electrode 80. While passing the second focusing aperture 81, the second electron beas 14*b* may be focused. The second focusing electrode 80 may be controlled to adjust the focusing such that the focal spot of the second electron beam 14*b* is minimized on the surface of the anode 40.

The second electron beam 14*b* passing through the second focusing aperture 81 may be irradiated to the anode 40. The second electron beam 14*b* is irradiated to the anode 40 and thus an X-ray 43 may be emitted from the anode 40. The X-ray 43 may travel from the anode 40 towards the image acquisition unit 50. The X-ray 43 may be irradiated to the subject SJ disposed between the anode 40 and the image acquisition unit 50.

The X-ray 43 may be irradiated to the image acquisition unit 50. The image acquisition unit 50 may acquire an X-ray image of the subject SJ. Since the X-ray image is acquired through one X-ray 43, the X-ray image of the subject SJ may be clear.

As the current magnitude of the second electron beam 14*b* passing through the limited aperture 71 is larger, clearer X-ray image may be acquired.

Figure 6:
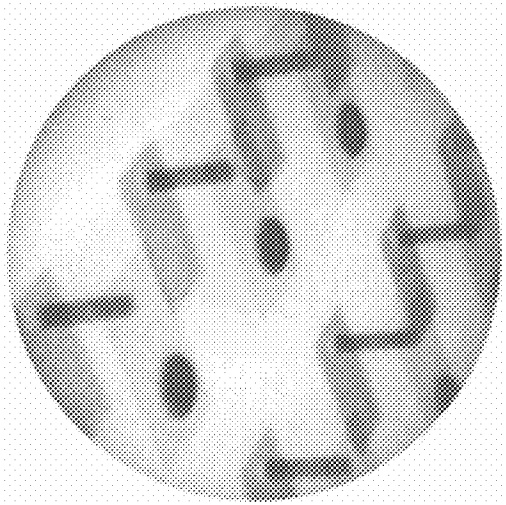
FIG. 6 is an X-ray image acquired by the X-ray imaging device according to FIG. 4.

FIG. 6 is an X-ray image acquired by the X-ray imaging device according to FIG. 4.

Referring to FIG. 6, it may be checked that the subject appears clearly in the X-ray image acquired by one X-ray.

Figure 7:
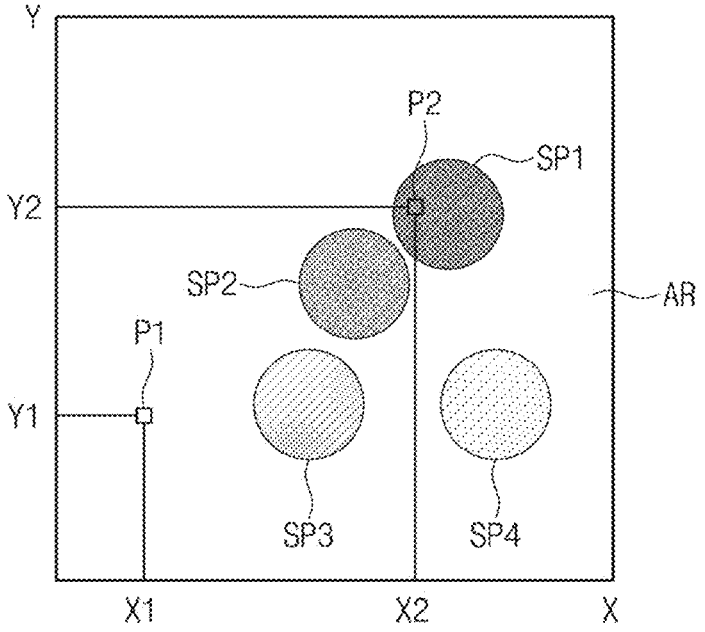
FIG. 7 is a drawing for explaining an intensity map of a current measured at a limited electrode.

FIG. 7 is a drawing for explaining an intensity map of the current measured at the limited electrode.

Referring to FIGS. 4, 5A, 5B, and 7, the intensity map of the current flowing through the limited electrode may be acquired using the current meter 73 connected to the limited electrode 70. The current intensity map may be acquired based on the electrostatic deflector (FIG. 5A) or the magnetic field deflector (FIG. 5B). Hereinafter, a description will be provided about a case where the electrostatic deflector (FIG. 5A) is exemplified. A case based on the magnetic field deflector (FIG. 5B) may also be similar as follows.

The current intensity map may be configured from a plurality of pixels. The magnitude of an X-voltage may be displayed on an X-axis of the current intensity map, and the magnitude of a Y-voltage of the deflector 60 may be displayed on Y-axis of the current intensity map. Each of the pixels may have the X-voltage magnitude and the Y-voltage magnitude corresponding thereto. For example, the X-voltage magnitude corresponding to a first pixel P1 is X1, and the Y-voltage magnitude corresponding thereto is Y1. For another example, the X-voltage magnitude corresponding to a second pixel P2 is X2, and the Y-voltage magnitude corresponding thereto is Y2. In other words, when the X-voltage magnitude of the deflector 60 is X1 and the Y-voltage magnitude is Y1, the intensity of a current flowing through the limited electrode 70 may appear in the first pixel P1 of the current intensity map. When the X-voltage magnitude of the deflector 60 is X2 and the Y-voltage magnitude thereof is Y2, the intensity of the current flowing through the limited electrode 70 may appear in the second pixel P2 of the current intensity map. As the above, the current intensity map may represent the intensity of the current flowing through the limited electrode 70 according to a magnitude change in X-voltage and a magnitude change in Y-voltage.

In the current intensity map, as the intensity of the current flowing through the limited electrode 70 is larger, the brightness of each pixel may be larger. When comparing the first pixel P1 with the second pixel P2, since the brightness of the first pixel P1 is larger than that of the second pixel P2, a case where the X-voltage of the deflector 60 is X1 and the Y-voltage thereof is Y1 may have a larger intensity of the current, which flows through the limited electrode 70, than a case where when the X-voltage of the deflector 60 is X2 and the Y-voltage thereof is Y2.

Acquiring the current intensity map may include changing the X-voltage magnitude and the Y-voltage magnitude of the deflector 60 within a specified range, and measuring the intensity of the current flowing through the limited electrode 70 according to the X-voltage magnitude and the Y-voltage magnitude within the range to display the brightness of pixels.

As shown in FIG. 4, when the first to fourth electron beams 14*a* to 14*d* are respectively emitted from the first to fourth nano-emitters 13*a* to 13*d*, first to fourth spots SP1 to SP4 and a peripheral area AR may be formed on the current intensity map. Each of the first to fourth spots SP1 to SP4 and the peripheral area AR may be formed of pixels of which brightness is identical. The first to fourth spots SP1 to SP4 may be relatively darker than the peripheral area AR. The second spot SP2 may be brighter than the first spot SP1, the third spot SP3 may be brighter than the second spot SP2, and the fourth spot SP4 may be brighter than the third spot SP3.

When the deflector 60 has an X-voltage and a Y-voltage corresponding to pixels located in the first spot SP1, an electron beam having the largest current magnitude among the first to the fourth electron beams 14*a* to 14*d* may pass through the limited aperture 71.

When the deflector 60 has an X-voltage and a Y-voltage corresponding to pixels located in the second spot SP2, an electron beam having the second largest current magnitude among the first to the fourth electron beams 14*a* to 14*d* may pass through the limited aperture 71.

When the deflector 60 has an X-voltage and a Y-voltage corresponding to pixels located in the fourth spot SP4, an electron beam having the smallest current magnitude among the first to the fourth electron beams 14*a* to 14*d* may pass through the limited aperture 71.

When the deflector 60 has an X-voltage and a Y-voltage corresponding to pixels located in the peripheral area AR, all of the first to fourth electron beams 14*a* to 14*d* may not pass through the limited aperture 71.

When the current intensity map is checked to control the deflector 60 such that the X-voltage magnitude and the Y-voltage magnitude of the deflector 60 correspond to the pixels in the first spot SP1, an electron beam having the largest current magnitude among the first to the fourth electron beams 14*a* to 14*d* may pass through the limited aperture 71.

In the current intensity map, the first to fourth spots SP1 to SP4 may reflect the shape of the limited electrode 71. In other words, when the limited aperture 71 is planarly circular, the first to fourth spots SP1 to SP4 may be formed in a circular shape, and when the limited aperture 71 is planarly rectangular, the first to fourth spots SP1 to SP4 may be formed in a rectangular shape FIGS. 8A to 8C are drawings for explaining a shape of an electron beam passing through a limited aperture.

Figure 8A:
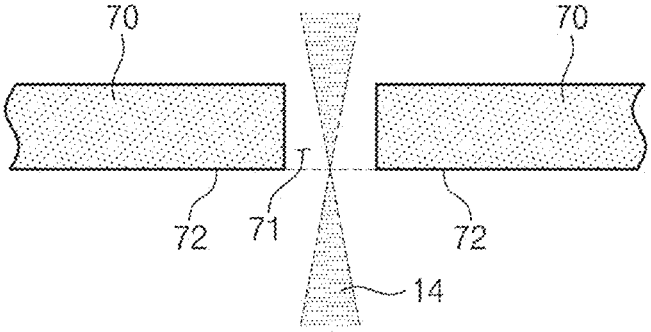
FIGS. 8A to 8C are drawings for explaining a shape of an electron beam passing through a limited aperture.

Referring to FIGS. 4, 7 and 8A, according to the focusing of the first focusing electrode 30, the electron beam 14 may be focused such that the planar area may be minimized in the same level as the bottom surface 72 of the limited electrode 70. In other words, the electron beam 14 may be focused such that a focal point is formed in the same level as the bottom surface 72 of the limited electrode 70. In this case, in the current intensity map of FIG. 7, the first to fourth spots SP1 to SP4 may be relatively clearly formed. Focusing of the electron beam 14 may be adjusted such that the planar area of the electron beam 14 is minimized in the same level as the bottom surface 72 of the limited electrode 70 by controlling the first focusing electrode 30. It may be checked whether the planar area of the electron beam 14 is minimized in the same level as the bottom surface 72 of the limited electrode 70 by checking the definition of the current intensity map.

Figure 8B:
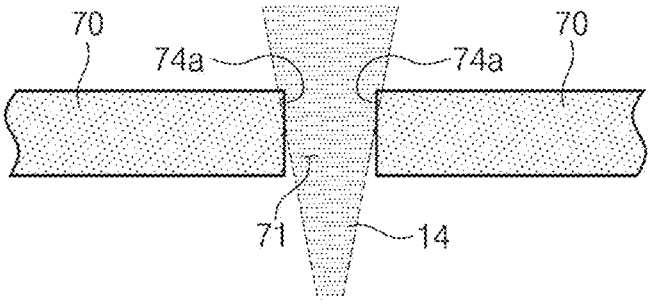

With reference to FIGS. 4 and 8B, according to the focusing of the first focusing electrode 30, the electron beam 14 may travel in a diverging type while passing through the limited aperture 71 of the limited electrode 70. In other words, as the electron beam 14 travels through the limited aperture 71, the planer area may gradually increase. The electron beam 14 may collide to top portions of side walls 74*a* of the limited aperture 71. X-rays may be generated by the electron beam 14 at the top portions of the side walls 74*a* of the limited aperture 71. The X-rays generated from the top portions of the side walls 74*a* of the limited aperture 71 may travel towards the anode 40. The X-rays may be irradiated to the subject SJ and the image acquisition unit 50. Due to the X-rays, the definition of an X-ray image acquired by the image acquisition unit 50 may be lowered.

Figure 8C:
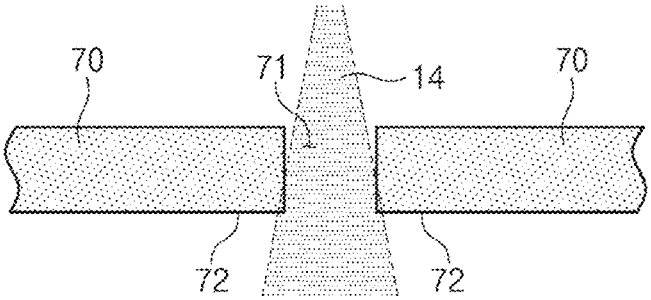

With reference to FIGS. 4 and 8C, according to the focusing of the first focusing electrode 30, the electron beam 14 may travel in a converging type while passing through the limited aperture 71 of the limited electrode 70. In other words, as the electron beam 14 travels through the limited aperture 71, the planer area thereof may gradually decrease. The electron beam 14 may collide to the bottom surface 72 of the limited electrode 70. Then, X-rays may be generated by the electron beam 14 from the bottom surface 72 of the limited electrode 70. The X-rays may be limited by the limited electrode 70 and may not travel toward the anode 40.

Figure 9A:
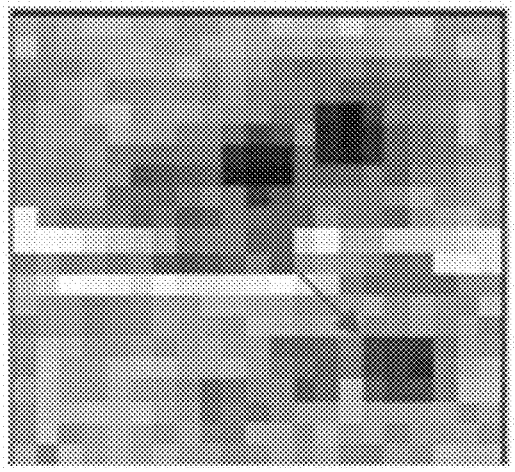
FIGS. 9A and 9B are real images of a current intensity map of a limited electrode.
Figure 9B:
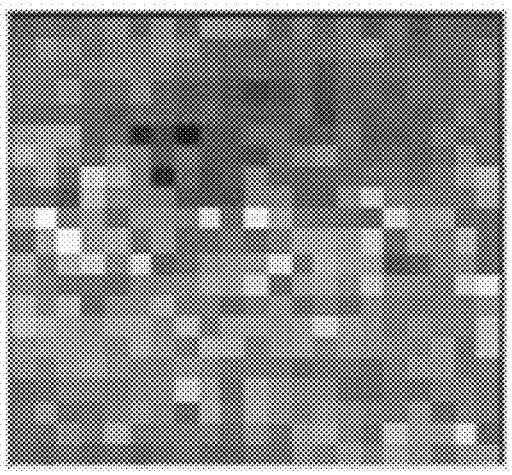

FIGS. 9A and 9B are real images of the current intensity map of the limited electrode.

Referring to FIGS. 9A and 9B, it may checked from the current intensity map of FIG. 9A that spots at which relatively dark pixels are gathered are formed distinguishably from other portions, whereas, in FIG. 9B, it is checked that the spots are not distinguishably formed from the other portions. Like FIG. 8A, when the planer area of the electron beam is minimized in the same level as the bottom surface of the limited electrode, the current intensity map like FIG. 9A may be acquired. Unlike FIG. 8A, when the planer area of the electron beam is larger than the diameter of the limited aperture in the same level as the bottom surface of the limited electrode, a current intensity map like FIG. 9B may be acquired. As the planar area of the electron beam becomes smaller in the same level as the bottom surface of the limited electrode, the definition of the current intensity map may be excellent.

Figure 10:
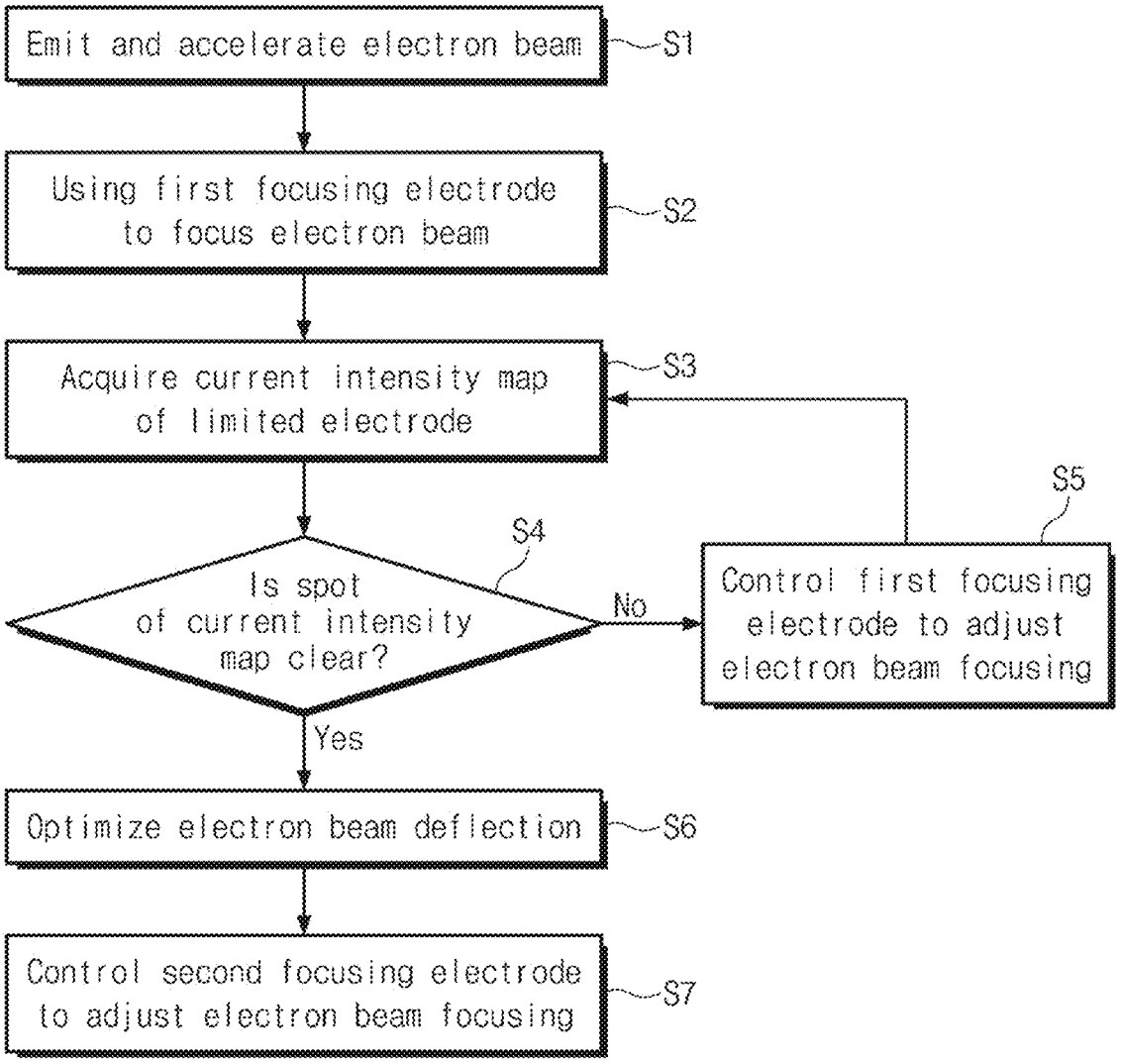
FIG. 10 is a flowchart for explaining a driving method of an X-ray imaging device according to an embodiment of the inventive concept.

FIG. 10 is a flow chart for explaining a driving method of the X-ray imaging device according to an embodiment of the inventive concept.

Referring to FIGS. 4 and 10, a voltage may be applied to the gate electrode 20 to emit the first to fourth electron beams 14*a* to 14*d* from the first to fourth nano-emitters 13*a* to 13*d*, and a voltage may be applied to the anode 40 to accelerate the first to fourth electron beams 14*a* to 14*d* (operation S1).

A voltage may be applied to the first focusing electrode 30 to focus the first to fourth electron beams 14*a* to 14*d* (operation S2).

An intensity map of a current flowing through the limited electrode 70 by the first to fourth electron beam 14*a* to 14*d* may be acquired using the deflector 60 and the current meter 73 (operation S3).

It is determined when the spots on the current intensity map are clear (operation S4). When the spots of the current intensity map are not clearly acquired, the first focusing electrode 30 may be controlled to adjust the focusing of the first to fourth electron beams 14*a* to 14*d*. The adjustment of the focusing may include minimizing a planar area of an electron beam passing through the limited aperture 71 in the same level as the bottom surface 72 of the limited electrode 70. The focusing of the first to fourth electron beams 14*a* to 14*d* is adjusted, and then again, by means of the deflector 60 and the current meter 73, the intensity map of the current flowing through the limited electrode 70 by the first to fourth electron beams 14*a* to 14*d* may be acquired. The above processes may be repeated until the spots of the current intensity map become clear.

It is determined whether the spots on the current intensity map are clear (operation S4), and when the spots on the current intensity map are clearly acquired, deflection of the first to fourth electron beams 14*a* to 14*d* may be optimized using the current intensity map (operation S6). The deflection optimization may include checking the darkest spot on the current intensity map, and controlling the deflector 60 to adjust the deflection of the first to fourth electron beams 14*a* to 14*d* so as to correspond to the darkest spot. When the deflector 60 is an electrostatic deflector (FIG. 5A), the magnitudes of voltages applied by the X-axis voltage source 62*a* and the Y-axis voltage source 62*b* may be optimized, and when the deflector 60 is a magnetic field deflector (FIG. 5B), the magnitudes of currents provided by the X-axis current source 64*a* and the Y-axis current source 64*b* may be optimized. According to the deflection optimization, an electron beam having the largest current value among the first to fourth electron beams 14*a* to 14*d* may pass through the limited aperture 71.

The focusing of the electron beam having passed through the limited aperture 71 may be adjusted by controlling the second focusing electrode 80 (operation S7). Accordingly, the electron beam may be focused such that a focal spot of the electron beam having passed through the limited aperture 71 is minimized on the surface of the anode 40.

Figure 11:
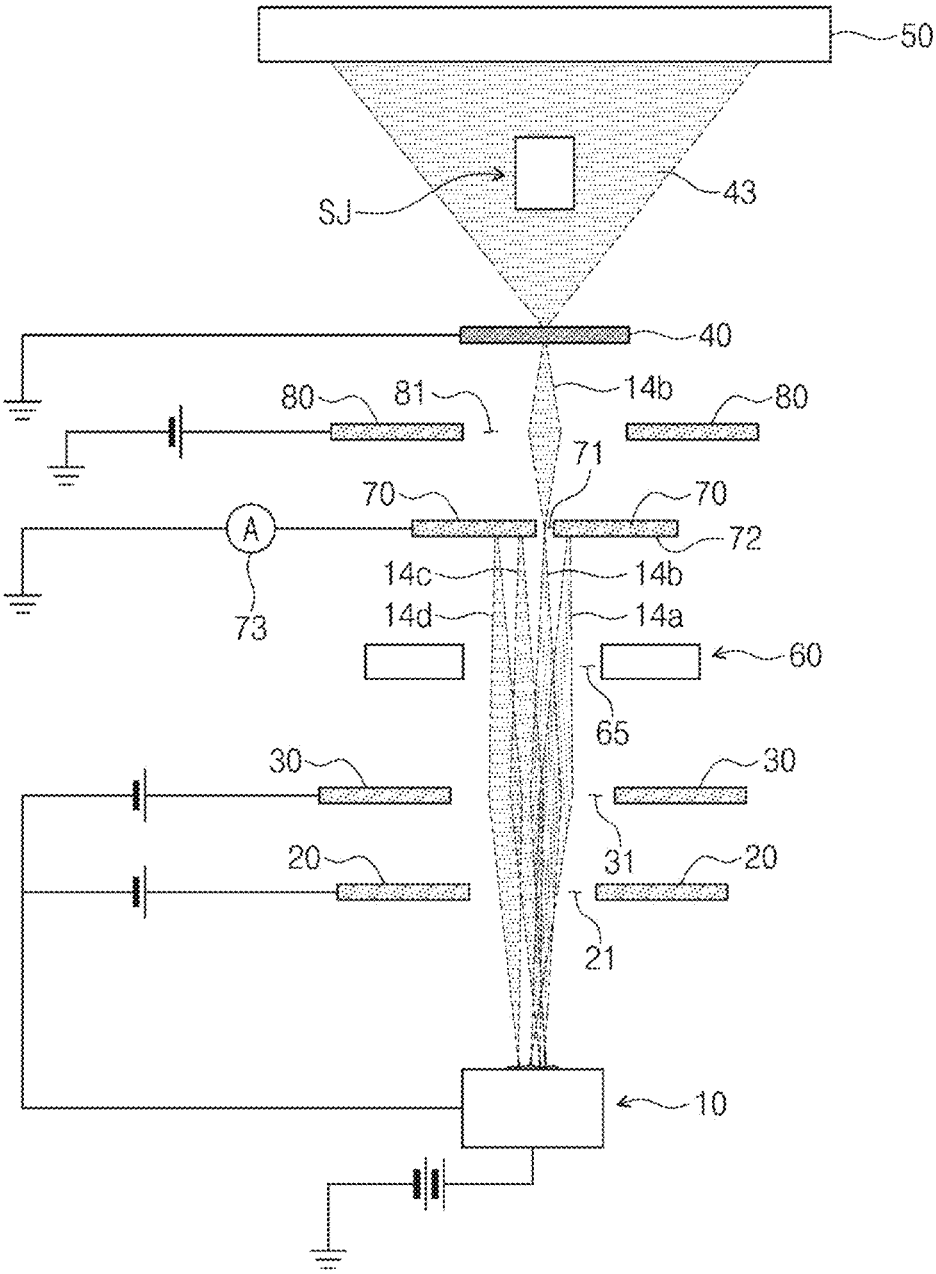
FIG. 11 is a drawing for explaining an X-ray imaging device according to embodiments of the inventive concept.

FIG. 11 is a drawing for explaining the X-ray imaging device according to embodiments of the inventive concept. Like reference numerals may be used for like elements having been explained in relation to FIG. 4, and overlapping explanation will be omitted.

With reference to FIG. 11, a negative voltage may be applied to the cathode 11 and the anode 40 may be grounded. The limit electrode 70 is illustrated to be grounded, but a negative voltage or a positive voltage may be applied thereto.

An X-ray imaging device according to exemplary embodiments of the inventive concept includes a deflector and a limited aperture to irradiate an anode with an electron beam, which has the largest current magnitude, among electron beams generated from a plurality of nano-emitters, and thus a clear image may be acquired.

Although the exemplary embodiments of the present invention have been described, it is understood that the present invention may be implemented as other concrete forms without changing the inventive concept or essential features. Therefore, these embodiments as described above are only proposed for illustrative purposes and do not limit the present disclosure.

What is claimed is:

1. An X-ray imaging device comprising:

an electron beam generation unit comprising a plurality of nano-emitters and a cathode;

a first focusing electrode configured to focus an electron beam emitted from the electron beam generation unit;

a deflector configured to deflect the electron beam focused by the first focusing electrode;

a limited electrode configured to limit traveling of the electron beam deflected by the deflector; and an anode configured to be irradiated with the electron beam to emit an X-ray, wherein the limited electrode comprises a limited aperture which the electron beam pass.

2. The X-ray imaging device of claim 1, further comprising:

a gate electrode configured to apply an electric field to the nano-emitters.

3. The X-ray imaging device of claim 1, further comprising:

an image acquisition unit configured to acquire an X-ray image using the X-ray emitted from the anode.

4. The X-ray imaging device of claim 1, wherein the deflector comprises:

electrodes separated from each other with an electron beam path therebetween; and a voltage source configured to apply voltages to the electrodes.

5. The X-ray imaging device of claim 1, wherein the deflector comprises:

coils separated from each other with an electron beam path therebetween; and a current source configured to provide a current to the coils.

6. The X-ray imaging device of claim 1, further comprising:

a second focusing electrode configured to focus the electron beam passing through the limited aperture.

7. The X-ray imaging device of claim 1, wherein the limited electrode further comprises a current meter configured to measure a current flowing through the limited electrode.

8. A driving method of an X-ray imaging device comprising:

emitting a plurality of electron beams from an electron beam generation unit;

limiting the traveling of the electron beams emitted from the electron beam generation unit by using a limited electrode; and irradiating at least part of the electron beams to an anode, wherein the limited electrode comprises a limited aperture which the electron beam pass.

9. The driving method of claim 8, wherein the limiting the traveling of the electron beams comprises one of the electron beams emitted from the electron beam generation unit passes the limited aperture.

10. The driving method of claim 9, wherein the irradiating at least part of the electron beams comprises using a second focusing electrode to focus the one electron beam.

11. The driving method of claim 8, wherein the limiting the traveling of the electron beams comprises using a first focusing electrode to focus the electron beams emitted from the electron beam generation unit.

12. The driving method of claim 11, wherein the limiting the traveling of the electron beams further comprises using a deflector to deflect the electron beams focused by the first focusing electrode.

13. The driving method of claim 12, wherein the limiting the traveling of the electron beams further comprises measuring a current flowing through the limited electrode to acquire a current intensity map of the limited electrode.

14. The driving method of claim 13, wherein the using a first focusing electrode to focus the electron beams comprises:

determining whether the current intensity map is clear; and controlling the first focusing electrode to adjust focusing of the electron beams.

15. The driving method of claim 14, wherein the controlling the first focusing electrode to adjust focusing of the electron beams comprises adjusting the focusing of the electron beams to minimize a planar area of the electron beams in a same level as a bottom surface of the limited electrode.

16. The driving method of claim 13, wherein the using a deflector to deflect the electron beams comprises controlling the deflector so as to correspond to a darkest spot on the current intensity map.

17. The driving method of claim 16, wherein the controlling the deflector comprises optimizing a magnitude of a voltage from a voltage source of the deflector.

18. The driving method of claim 16, wherein the controlling the deflector comprises optimizing a magnitude of a current from a current source of the deflector.

* * * * *